US009061851B2

(12) United States Patent
Ikeda et al.

(10) Patent No.: US 9,061,851 B2
(45) Date of Patent: Jun. 23, 2015

(54) SHEET FEEDING DEVICE AND IMAGE FORMING APPARATUS

(75) Inventors: Taro Ikeda, Tokyo (JP); Yuji Yamanaka, Toride (JP); Shinsuke Ubayashi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 288 days.

(21) Appl. No.: 12/689,197

(22) Filed: Jan. 18, 2010

(65) Prior Publication Data

US 2010/0183350 A1 Jul. 22, 2010

(30) Foreign Application Priority Data

Jan. 20, 2009 (JP) ..... 2009-010145

(51) Int. Cl.

*G03G 15/00* (2006.01)
*B65H 1/04* (2006.01)
*B65H 1/26* (2006.01)

(52) U.S. Cl.

CPC ..... *B65H 1/266* (2013.01); *B65H 2402/64* (2013.01); *B65H 2405/15* (2013.01); *B65H 2405/32* (2013.01); *B65H 2511/10* (2013.01); *G03G 15/6564* (2013.01)

(58) Field of Classification Search

CPC ..... B65H 1/266; B65H 1/04; B65H 2405/10; B65H 2405/31; B65H 2405/32; B41J 13/103; G03G 15/6502; G03G 2215/00383

USPC ..... 399/388, 389, 393; 271/162, 171, 234, 271/236, 238, 164

See application file for complete search history.

(56) References Cited

U.S. PATENT DOCUMENTS

| | | | | |
|---|---|---|---|---|
| 5,839,047 | A * | 11/1998 | Hirabayashi et al. | 399/389 |
| 7,637,496 | B2 * | 12/2009 | Sakanashi | 271/171 |
| 7,731,183 | B2 * | 6/2010 | Ohno et al. | 271/171 |
| 2006/0180997 | A1 * | 8/2006 | Ichikawa et al. | 271/162 |
| 2008/0251996 | A1 | 10/2008 | Ubayashi | |

FOREIGN PATENT DOCUMENTS

| | | |
|---|---|---|
| JP | 9-110193 | 4/1997 |

* cited by examiner

*Primary Examiner* — Blake A Tankersley

(74) *Attorney, Agent, or Firm* — Canon USA Inc. IP Division

(57) ABSTRACT

A sheet feeding device includes a sheet accommodating unit supported by an apparatus main body in an insertable and withdrawable manner in a direction orthogonal to a feeding direction of the sheets, a leading edge regulating unit provided fixedly to the sheet accommodating unit, a trailing edge regulating unit provided in the sheet accommodating unit, a side edge regulating unit provided in the sheet accommodating unit, and an insertion position limiting unit configured to contact a frame on a rear of the apparatus main body in an inserting direction of the sheet accommodating unit to limit an insertion position of the sheet accommodating unit, wherein the insertion position limiting unit is arranged on a rear of the sheet accommodating unit and on an upstream of a position of center of gravity of the sheet accommodating unit along a sheet feeding direction.

6 Claims, 10 Drawing Sheets

SHEET FEEDING DEVICE AND IMAGE FORMING APPARATUS

BACKGROUND OF THE INVENTION

1. Field of the Invention

The present invention relates to a sheet feeding device for feeding a sheet one by one from loaded sheets and an image forming apparatus equipped with the sheet feeding device.

2. Description of the Related Art

Conventionally, an image forming apparatus that forms an image on a sheet includes a copying machine, a printer, and a facsimile machine. The copying machine is generally provided with a function for reading an image such as a document, converts the read image into electronic information, and forms an image on a sheet according to the electronic information. In recent years, there has been a copying machine provided with a communication function for receiving electronic information of images transmitted from an external device, and forms an image on a sheet according to the received electronic information of images.

A printer is generally provided with a function for forming an image on a sheet according to electronic information of an image transmitted from an external device, for example, a computer. Further, a facsimile machine is generally provided with a function for reading an image of a document or the like and for communication, and transmits the electronic information of the read image to an external device, and also forms an image on a sheet according to electronic information of an image transmitted from an external device.

In these image forming apparatuses, a sheet feeding device including a sheet accommodating unit that loads and accommodates sheets, and a sheet feeding unit that feeds the sheets from the sheet accommodating unit, is arranged at a lower part or a side part of an apparatus main body. The sheets are supplied from the sheet feeding device to the image forming unit, and images are formed on the sheets by the image forming unit.

In the sheet feeding device, when a sheet is fed from the sheet accommodating unit, it is necessary to prevent a skew of the fed sheet and a shift (lateral shift) in the sheet in a direction orthogonal to a sheet feeding direction of the sheet (hereinafter, referred to as a widthwise direction). For this reason, in the sheet accommodating unit, there is provided a pair of side edge regulating members that contact both side edges of the sheets for regulating a position in the widthwise direction of the sheets to be accommodated.

In the sheet accommodating unit that can accommodate a plurality of sizes of the sheets, the side edge regulating members are movably provided in the widthwise direction according to a size of the sheets to be accommodated.

In the so-called conveyance in the image forming apparatus with reference to the center, a sheet in any size is conveyed such that the center of the widthwise direction of the sheet coincides with the center of the widthwise direction of a conveyance path. In the image forming apparatus, in the so-called conveyance with reference to the center, a pair of the side edge regulating members is movable to be interlocked therebetween in order to improve operability.

A mechanism to effect for interlocking thereof generally uses a rack provided in each of the pair of side edge regulating members and a pinion that is in meshed engagement with each rack. With the configuration, when the one of the pair of side edge regulating members is moved, a rack of the pair of side edge regulating members causes the pinion to rotate, thereby causing the rack of the other side edge regulating member to move, and then causing in turn the other side edge regulating member to move.

In the sheet accommodating unit provided with the side edge regulating members with this configuration, after positions of the pair of the side edge regulating members are determined according to a size of the sheets, the pair of the side edge regulating members are locked by a locking mechanism so that the side edge regulating members do not move. Such a locking mechanism is generally configured such that the side edge regulating members are locked by causing ratchet teeth provided on the side edge regulating members, and urged by a spring to be engaged with rack gears fixed to the sheet accommodating unit.

In an image forming apparatus including such the side edge regulating members, and in which an insertion direction of the sheet accommodating unit into the apparatus main body and a feeding direction of a sheet from the sheet accommodating unit are orthogonal to each other, the following problem arises.

If the sheet accommodating unit with sheets is rapidly inserted into the apparatus main body, a shock is exerted from the sheets onto the side edge regulating members on a rear by the inertia of the sheets when the sheet accommodating unit stops. Accordingly, the side edge regulating members on the rear might be eventually displaced outwardly.

As a result, in some cases, the position of the sheets has been eventually shifted, causing a defective image in which positions of a sheet and an image are not correct, and the sheets have been skewed, causing a paper jam within the conveyance path. In particular, in the case of a sheet accommodating unit with a large accommodation volume of sheets, this problem noticeably occurs since an inertia force of the sheets is larger.

Thus, to solve this problem, it is necessary to ensure a locking of a locking mechanism of the side edge regulating members. For this reason, as discussed in Japanese Patent Application Laid-Open No. 9-110193, there is provided a locking mechanism in which by using a force when a sheet accommodating unit is mounted on an image forming apparatus main body, a pair of side edge regulating members are fixed by a frictional force induced by frictional members.

Further, as discussed in US Publication 2008/0251996, in a configuration in which side edge regulating members are moved by a plurality of racks and pinions, there is provided a locking mechanism in which gears are arranged coaxially with respect to the pinions, and then the side edge regulating members are locked by fixing the gears.

In a conventional configuration in which the side edge regulating members are locked for preventing the shift of the sheets, various parts have to be added, which causes a complicated configuration of the apparatus, and causes cost to increase.

SUMMARY OF THE INVENTION

The present invention is directed to a sheet feeding device and an image forming apparatus that can prevent occurrence of displacement of regulating members that regulate sheets in a simple configuration, without the need of a significant change from the conventional configuration.

According to an aspect of the present invention, a sheet feeding device includes a sheet accommodating unit that accommodates sheets, and supported by an apparatus main body in an insertable and withdrawable manner in a direction orthogonal to a feeding direction of the sheets, a leading edge regulating unit provided fixedly to the sheet accommodating unit, configured to regulate a position on a downstream of the sheets to be accommodated in the feeding direction thereof, a trailing edge regulating unit provided in the sheet accommodating unit, configured to regulate a position on an upstream of the sheets to be accommodated in the feeding direction, a side edge regulating unit provided in the sheet accommodating unit, configured to regulate a position of the sheets to be accommodated in a direction orthogonal to the feeding direction thereof, and an insertion position limiting unit provided in the sheet accommodating unit, configured to contact a frame on a rear of the apparatus main body in an inserting direction of the sheet accommodating unit to limit an insertion position of the sheet accommodating unit, wherein the insertion position limiting unit is arranged on a rear of the sheet accommodating unit in the inserting direction thereof and on an upstream of a position of center of gravity of the sheet accommodating unit along a sheet feeding direction.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
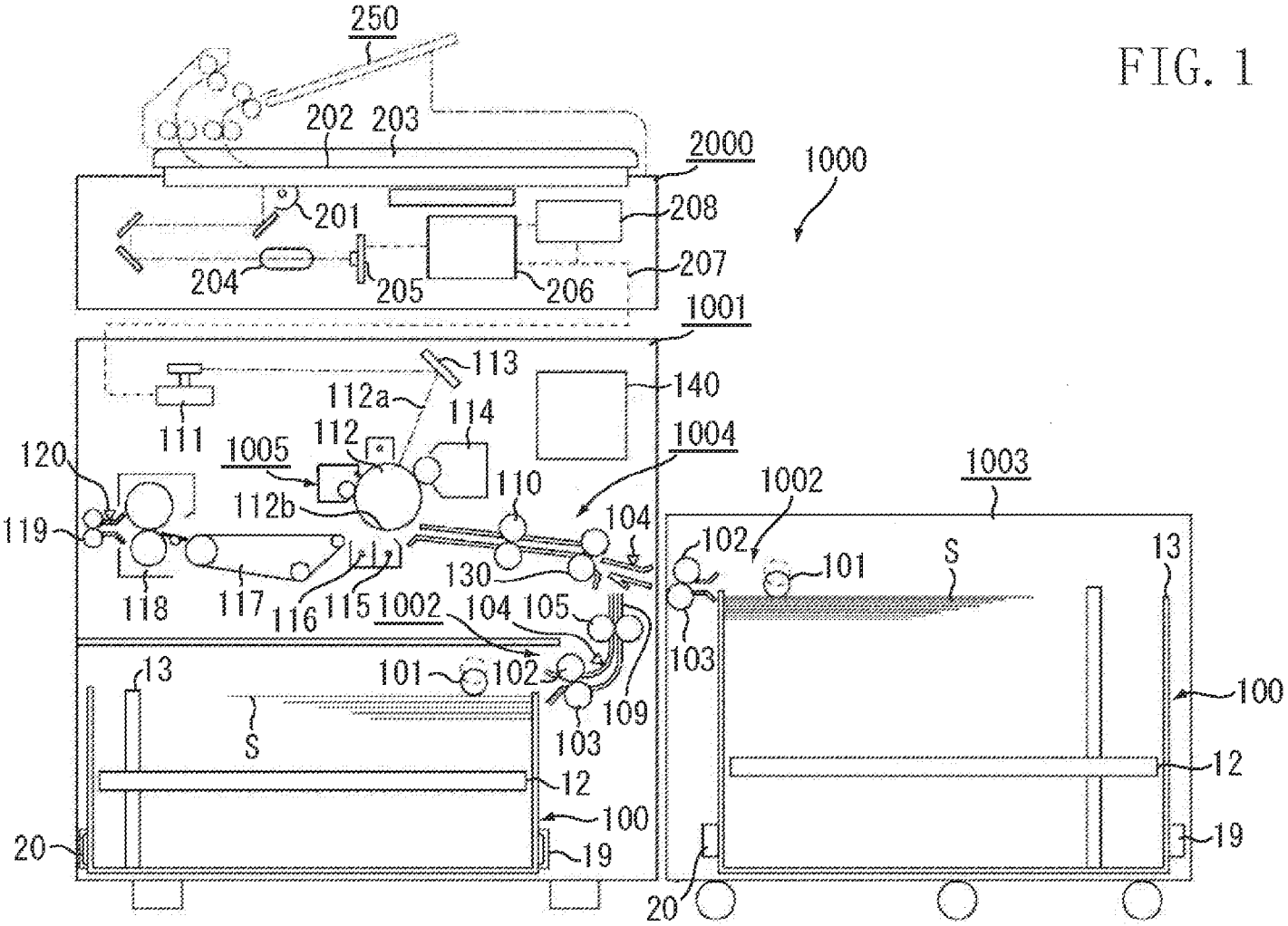
FIG. 1 is a cross-sectional view of an image forming apparatus according to an exemplary embodiment of the present invention.

FIG. 1 is a cross-sectional view of a printer as an example of an image forming apparatus including a sheet feeding device according to a first exemplary embodiment of the present invention.

In FIG. 1, a printer 1000 includes a printer main body 1001, and a scanner 2000 arranged on the top of the printer main body 1001, for reading out a document. The scanner 2000 includes a scanning optical system light source 201, a platen glass 202, an open-close document pressing plate 203, a lens 204, and a light-receiving unit (photoelectric conversion unit) 205. Moreover, the scanner 2000 includes an image processing unit 206, and a memory unit 208 that stores an image signal processed in an image processing unit 206.

Then, when a document is read out, an image on the document is read out by irradiating a light onto the document (not illustrated) mounted on the platen glass 202 by a scanning optical system light source 201. The read out document image, after having been processed by the image processing unit 206, is converted into an electrically encoded electric signal 207 and transmitted to a laser scanner 111 serving as an image forming device.

Image information processed and encoded by the image processing unit 206 is temporarily stored in the memory unit 208, and can be also transmitted to the laser scanner 111 as necessary, in response to a signal from a controller 140 described below.

The printer main body 1001 includes an image forming unit 1005, as described below, and a controller 140 serving as a control unit for controlling the printer 1000. In a lower part of the image forming unit 1005, a sheet feeding device C1 that supplies a sheet S to the image forming unit 1005 is arranged, and the sheet S fed from the sheet feeding device C1 is conveyed by a sheet conveyance device 1004 to the image forming unit 1005. The sheet feeding device C1 includes a sheet feeding unit 1002 for separating and feeding the sheets by one by one.

A sheet feeding device C2 is demountably provided on the printer main body 1001 as an option, and serves as a paper deck that can accommodate a large amount of sheets. The sheet feeding device C2 also includes a sheet feeding unit 1002 that feeds the sheet S toward the image forming unit 1005.

Since the sheet feeding device C1 and the sheet feeding device C2 are similar to each other in a basic configuration, features of the present invention will be described referring to the sheet feeding device C2.

In the sheet feeding device C2, a sheet accommodating unit 100 is withdrawably provided, and the sheet accommodating unit 100 can be withdrawn toward the front of the sheet surface in FIG. 1.

Further, the sheet feeding unit 1002 includes a pickup roller 101 that feed out the sheet, a feed roller 102 that rotates in a sheet feeding direction, and a retard roller 103 that rotates in a sheet returning direction. Then, the sheet fed by the pickup roller 101 is separated one by one between the feed roller 102 and the retard roller 103.

The sheet feeding device C1 provided on the printer main body 1001 includes also the pickup roller 101, and the feed roller 102 and the retard roller 103 in a similar manner. In addition, a sheet feeding sensor 104 is provided near the feed roller 102 and the retard roller 103 in a downstream in the sheet conveying direction thereof, and passage of the sheet S therethrough can be detected by the sheet feeding sensor 104.

The sheet conveying device 1004 includes a conveyance roller pair 105, a conveyance guide 109, and a registration roller unit composed of a before-registration roller pair 130 and a registration roller pair 110. The sheet S fed from the sheet feeding device C1 is temporarily made to abut by the conveyance roller pair 105 and the before-registration roller pair 130 against the registration roller pair 110 at rest.

Similarly, the sheet S fed from the sheet feeding device C2 is also temporarily made to abut by the before-registration roller pair 130 against the registration roller pair 110 at rest. Thereby, a skew that occurs on the sheets S during the sheet feeding and conveyance is corrected, and after that, the sheets S are conveyed to the image forming unit 1005 by the rotation of the registration roller pair 110.

The image forming unit 1005 includes a photosensitive drum 112, a laser scanner 111, a developing device 114, a transfer charging device 115, a separation charging device 116. Then, when an image is formed, a laser beam from the laser scanner 111 is returned back by a mirror 113 and irradiated onto an exposure position 112*a* on the photosensitive drum that rotates in a clockwise direction, thereby forming a latent image onto the photosensitive drum 112. Moreover, the latent image formed on the photosensitive drum 112 is visualized by the developing device 114 as a toner image.

The irradiated position of the laser beam can be changed via a laser writing position control circuit according to a control signal from the controller 140. Accordingly, the latent image formation starting position in an axial direction on the photosensitive drum 112, so-called a main scanning direction can be changed.

The toner image on the photosensitive drum 112 is transferred onto the sheet S conveyed by the transfer charging device 115, in a transfer unit 112*b*. Moreover, the sheet S on which the toner image has been thus transferred, is electrostatically separated from the photosensitive drum 112 by the separation charging device 116, and subsequently conveyed to the fixing device 118 by the conveyance belt 117 and thus toner image is fixed.

After that, the sheet S on which the toner image has been fixed, is discharged to the outside of the apparatus by a discharging roller 119. Further, a sheet discharging sensor 120 is provided in a conveyance route between the fixing device 118 and the discharging roller 119, and passage of the sheet S can be detected there.

In the present exemplary embodiment, while the printer main body 1001 and the scanner 2000 are provided separately from each other, the printer main body 1001 and the scanner 2000 may be provided integrally with each other. Further, the printer main body 1001, regardless of whether separately from or integrally with the scanner 2000, works as a copying machine if a processed signal of the scanner 2000 is input into the laser scanner 111, and works as a facsimile machine if a transmit signal of the facsimile machine is input thereinto.

Moreover, if an output signal of a personal computer is input thereinto, it works as a printer. Conversely, if a processed signal of the image processing unit 206 of the scanner 2000 is transmitted to another facsimile machine, the scanner 2000 works as a facsimile machine. Further, in the scanner 2000, if an automatic document feeding apparatus 250 is mounted as indicated by an alternate long and two short dashes line in place of the document pressing plate 203 thereon, it can also convey and read out the document.

Figure 2:
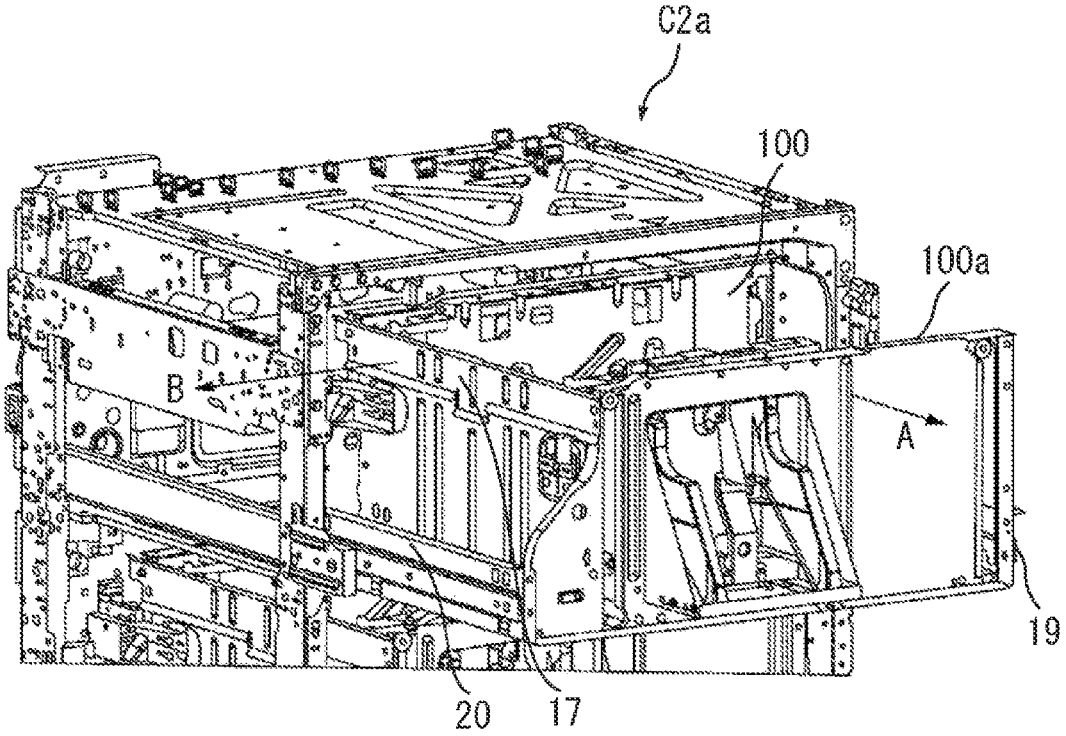
FIG. 2 is a perspective view of a sheet feeding device illustrated in FIG. 1.

Next, the sheet accommodating unit 100 of the sheet feeding device C2 will be described. FIG. 2 is a perspective view of the sheet accommodating unit 100, and the sheet accommodating unit 100 can be withdrawn along slide rails 19 and 20 from a frame C2*a* as a device main body serving as a skeleton framework of the device.

A withdrawing direction of the sheet accommodating unit 100 indicated by an arrow A in FIG. 2 coincides with an orthogonal direction (widthwise direction) to a sheet feeding direction indicated by an arrow B. Then, replenishment of the sheets S by a user is performed by withdrawing the sheet accommodating unit 100 toward the frond (in the direction of the arrow A).

Figure 3:
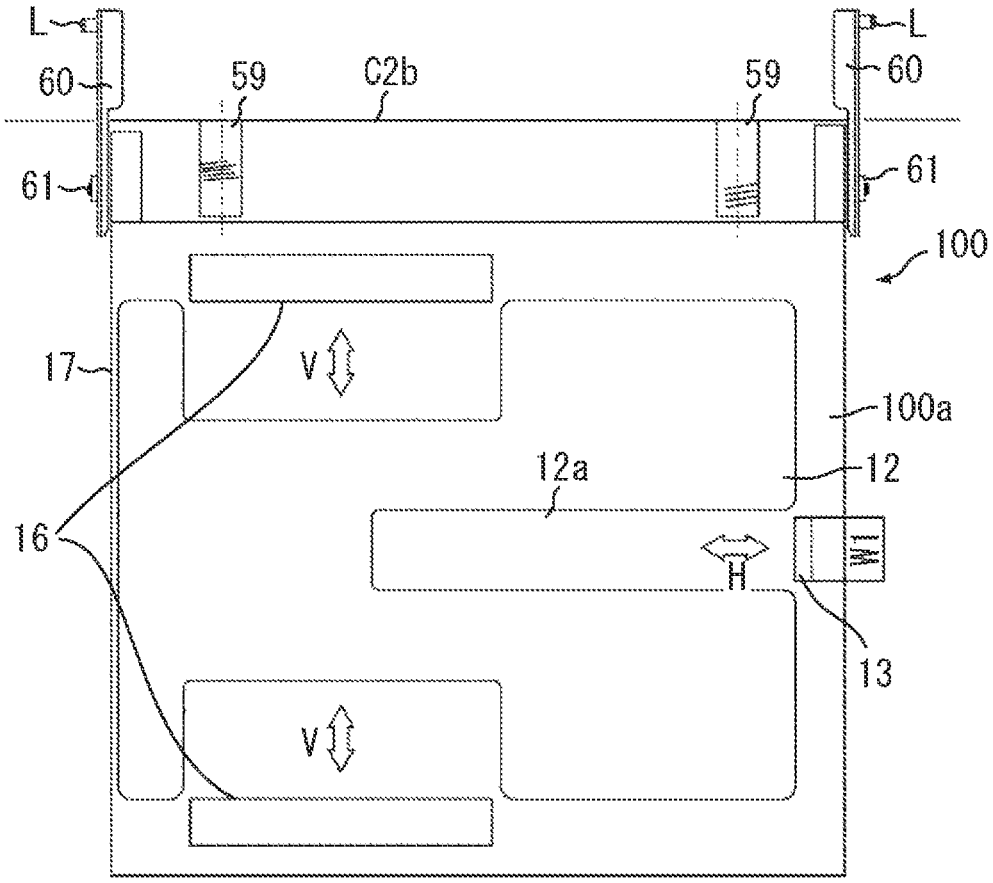
FIG. 3 is a plan view of a sheet accommodating unit provided in the sheet feeding device illustrated in FIG. 1.

FIG. 3 illustrates a schematic plan view of the sheet accommodating unit 100. The printer 1000 employs a scheme to convey a sheet with reference to the center, and the sheet accommodating unit 100 can accommodate various sizes of sheets from a sheet of a minimum size to a sheet of a maximum size, on which images can be formed by the image forming unit. For this purpose, a trailing edge regulating unit 13 that regulates a position of the sheet on the upstream in the sheet feeding direction, and a side edge regulating unit 16 that regulates a sidewise position of the sheet are mounted in a slidably movable manner onto the casing 100*a*, so that they can move according to a size of the sheet.

The trailing edge regulating unit 13 is slidably movable in "H" direction in FIG. 3 (the same direction as that of the sheet feeding direction), and the side edge regulating unit 16 is slidably movable in "V" direction in FIG. 3 (the same direction as a demounting direction of the sheet accommodating unit). The trailing edge regulating unit 13 and the side edge regulating unit 16 are fixed by the locking mechanism that is generally used at positions where they have been slid.

Further, as illustrated in FIG. 2, the casing 100*a* is formed in a box-shape where a part of the trailing edge side is notched, and the leading edge regulating unit 17 that constitutes a front wall of the casing 100*a* is fixedly provided on a downstream in the sheet feeding direction. Then, a leading edge of the sheets S loaded on a lifter 12 is regulated in its position by the leading edge regulating unit 17.

The lifter 12 is configured to be movable in the vertical direction by a lifting mechanism (not illustrated) within the sheet accommodating unit 100, and can move the topmost sheet of the loaded sheets S to a feedable position.

As described above, in order to deal with various sizes of the sheets, the trailing edge regulating unit 13 is provided in a slidably movable manner. However, a width W1 of the trailing edge regulating unit 13 is configured to be smaller than a width of a sheet of a minimum size, in order to keep the strength of the lifter 12. More specifically, a notch 12*a* is formed in the lifter 12 so that the trailing edge regulating unit 13 can move. In order to keep the strength of the lifter 12 by making the width of the lifter 12 as small as possible, the width of the trailing edge regulating unit 13 is made smaller.

Figure 4:
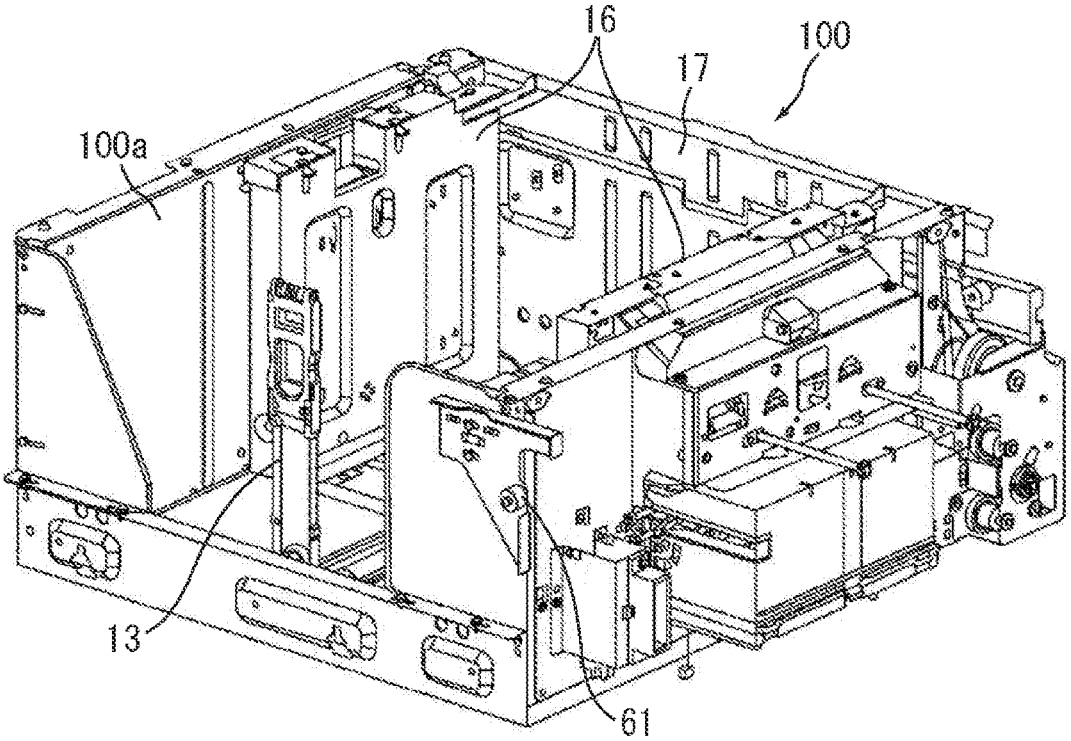
FIG. 4 is a perspective view of the sheet accommodating unit illustrated FIG. 3.

Further, in the present exemplary embodiment, the sheet accommodating unit 100 can accommodate about 2000 pieces of sheets at maximum. For this reason, since the trailing edge regulating unit 13 needs to regulate the trailing edges of the accommodated sheets S over the full extent in a vertical direction, it is configured to be long in a height direction as illustrated in FIG. 4. As a result, the trailing edge regulating unit 13 is hard to secure its strength as compared with the side edge regulating unit 16 and the leading edge regulating unit 17 that constitutes the casing 100*a* of the sheet accommodating unit 100.

Next, the locking mechanism for fixing in the frame C2*a*, when the sheet accommodating unit 100 is housed within a frame C2*a* serving as the apparatus main body, will be described.

Figure 5:
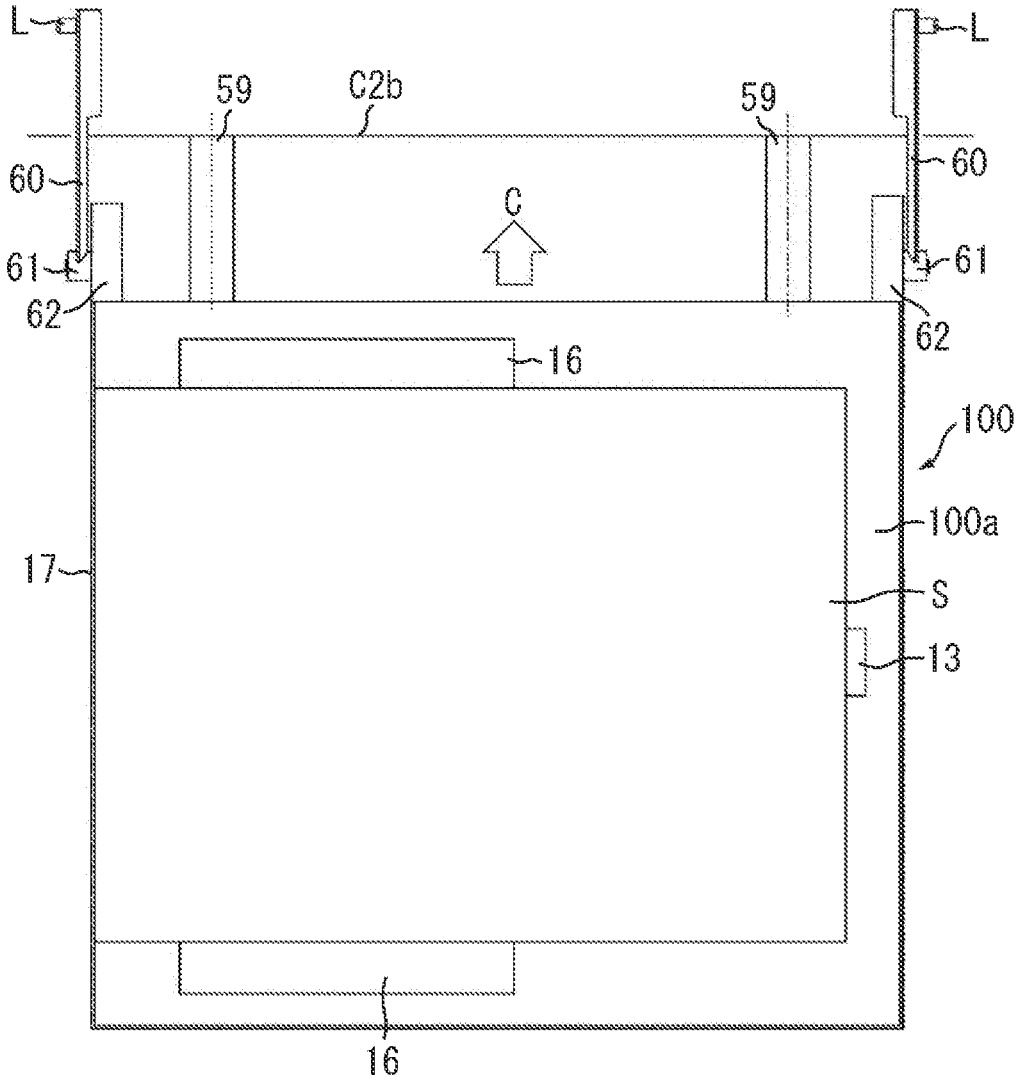
FIG. 5 is a plan view illustrating a housing operation of the sheet accommodating unit illustrated in FIG. 3 into a casing.
Figure 6A:
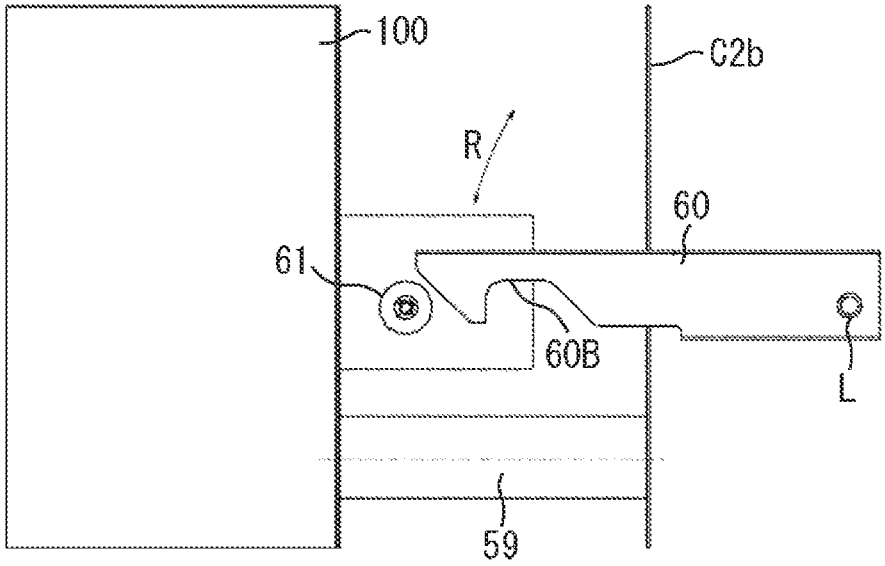
FIGS. 6A and 6B are side views illustrating a locking mechanism when the sheet accommodating unit illustrated in FIG. 3 is housed into the casing.
Figure 6B:
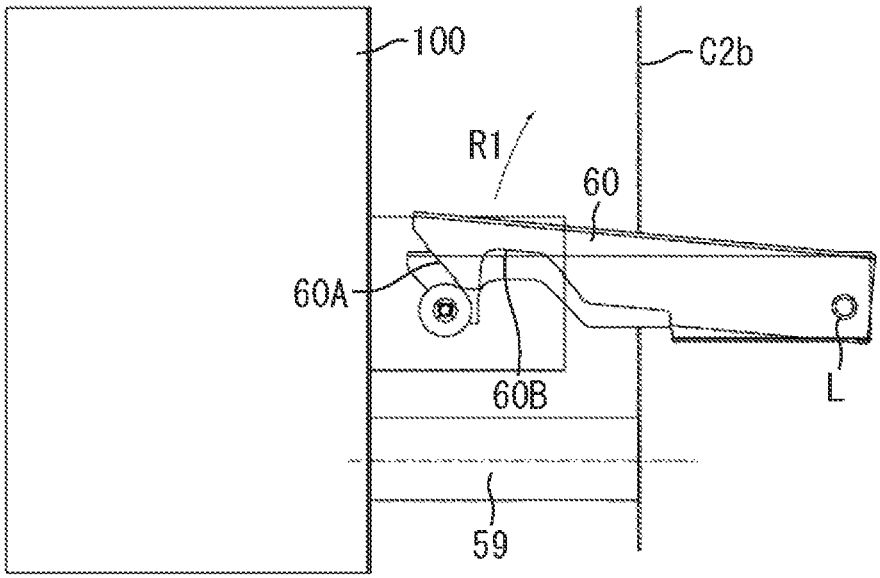

FIG. 5 and FIGS. 6A and 6B illustrate situations in which the sheet accommodating unit 100 that has been withdrawn is being inserted into the frame C2*a*. FIG. 5 is a top view of the sheet accommodating unit 100, and FIGS. 6A and 6B are right side views.

Lock rollers 61 are provided at abutting portions 62, described below, of the sheet accommodating unit 100, and hook portions 60 supported rotatably in the direction of an arrow R in FIG. 6A around "L" are provided within the frame C2*a*. The hook portions 60 are maintained in a state illustrated in FIG. 6A by lock springs (not illustrated).

A locking operation by the locking mechanism will be described. When the sheet accommodating unit 100 is pushed in C direction in FIG. 5, springs 59 attached to the frame C2*a* and the sheet accommodating unit 100 come into contact with each other, which absorbs a shock when the sheet accommodating unit 100 is being pushed in. After that, the rotatably supported hook portions 60 abut against the lock rollers 61.

In FIG. 6B, when the hook portion 60 abuts against the lock roller 61, the hook portion 60 rotates in an arrow R1 direction in FIG. 6B against an elastic force of the lock spring (not illustrated) along a slope 60A. Then, when the sheet accommodating unit 100 is further pushed in, finally the lock roller 61 fits into a groove portion 60B of the hook portion 60.

Figure 7A:
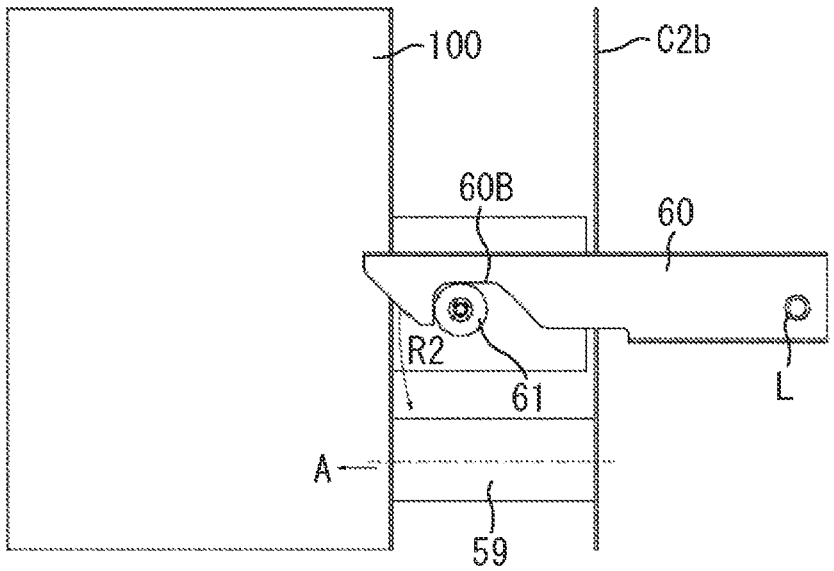
FIGS. 7A and 7B are side views illustrating a locking mechanism when the sheet accommodating unit illustrated in FIG. 3 is housed into the casing.

In FIG. 7A, while the sheet accommodating unit 100 is urged in an arrow A direction in FIG. 7A by a spring 59, the sheet accommodating unit 100 is positioned by the hook portion 60 being urged in a R2 direction in FIG. 7A by the lock spring (not illustrated).

In the present exemplary embodiment, an urging action by the lock spring is released in synchronization with a manipulation of a handle or the like so that a user can withdraw the sheet accommodating unit 100, and the sheet accommodating unit is configured to be automatically pushed out by a length corresponding to the stroke of the spring 59 by a force of the spring 59.

In the present exemplary embodiment, the sheet accommodating unit 100 can accommodates about 2000 pieces of the sheets S, and accommodatable size of sheets is 13 inch (about 330 mm) wide, and 19 inch (about 483 mm) long at maximum. Then, when a maximum number of sheets of maximum size are accommodated, the total weight amounts to about 40 kg if the sheets have a large grammage.

In order not to impair an operation feeling when such a heavy object is inserted into the frame C2*a*, the sheet accommodating unit 100 can be mounted and demounted by using a slide rail. However, if the sheet accommodating unit 100 is configured to be smoothly and slidably movable by using the slide rail, when the user pushes the sheet accommodating unit 100 with a big force, a great shock is given onto the frame C2*a* by an inertia induced by the weight of the sheets.

Although such a shock is loosened by the spring 59, a spring with a very strong elastic force must be used for ensuring to absorb the shock. However, if the spring with the strong elastic force is used, a pushing force required for the user to push the sheet accommodating unit 100 thereinto increases. On the contrary, since the operation feeling is eventually impaired, the spring with strong elastic force cannot be used.

Figure 7B:
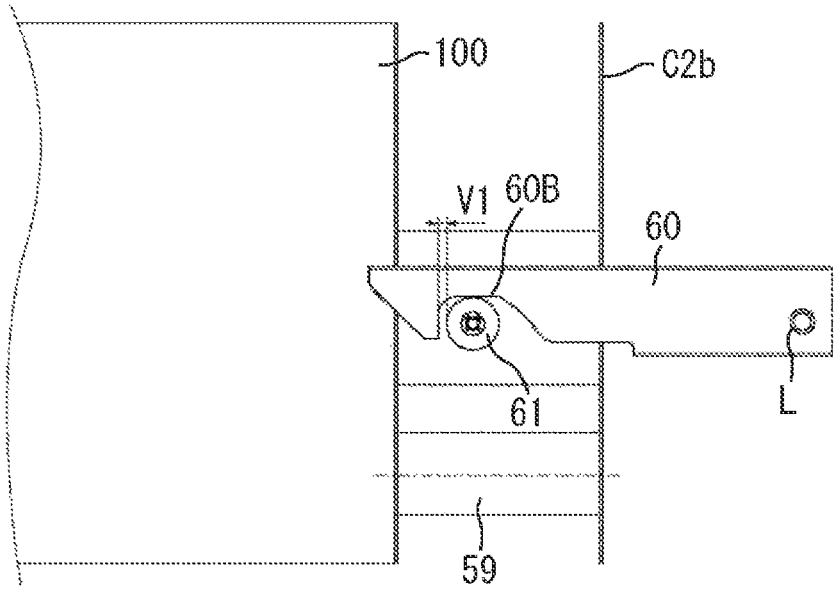

As illustrated in FIG. 7B, in consideration of variation of engagement between the hook portion 60 and the lock roller 61 of the locking mechanism, an over stroke V1 of the sheet accommodating unit 100 is set. Therefore, if the pushing force of the sheet accommodating unit 100 can not be completely absorbed by the spring 59, the sheet accommodating unit 100 will be eventually moved backward by an amount of the over stroke V1.

Figure 8:
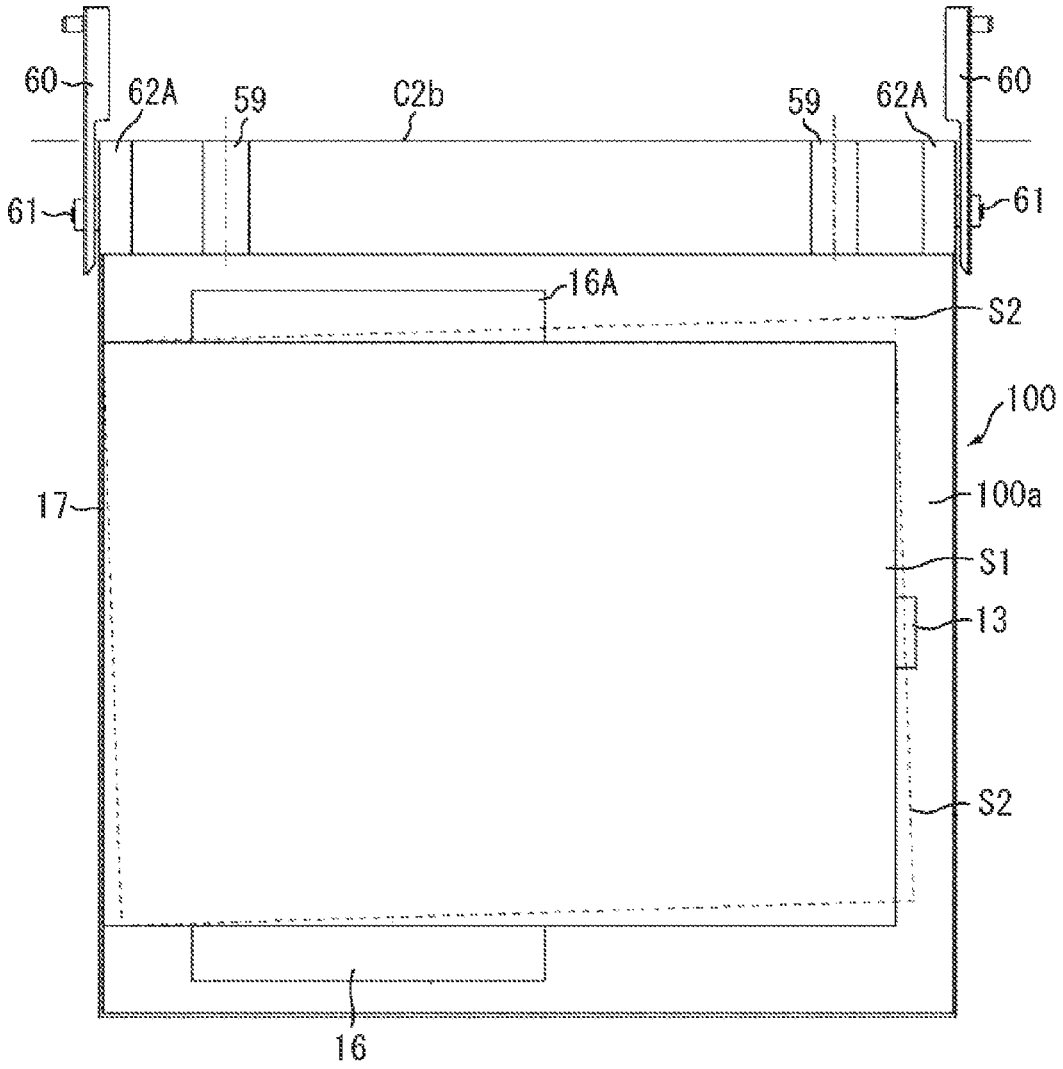
FIG. 8 PRIOR ART
FIG. 8 is a plan view illustrating a housing operation of the conventional sheet accommodating unit.

Conventionally, the over stroke V1 is set by the abutting portions 62A serving as an insertion position limiting portion provided at left and right of the rear of the sheet accommodating unit 100 illustrated in FIG. 8 and a back side frame C2*b* of the frame C2*a*. In other words, the sheet accommodating unit 100 is designed to enable an over stroke up to a position where the abutting portions 62A of the sheet accommodating unit 100 contact the back side frame C2*b*.

With the configuration, if the sheet accommodating unit 100 is rapidly pushed into the frame C2*a*, brought into an over stroke, and stopped, the sheets S1 may collide (press) against the rear of the side edge regulating unit 16A by the inertia and thus may cause damage thereon.

Further, as illustrated in FIG. 8, if the side edge regulating unit 16 regulates big size sheets, it regulates a front of the sheets in the feeding direction, but does not regulate aback of the sheets. For this reason, when the sheets collide against the side edge regulating unit 16, the sheets will turn in an anti-clockwise direction like S2 indicated by dotted line in FIG. 8.

Then, the turning of the sheets will be regulated by the trailing edge regulating unit 13, but the trailing edge regulating unit 13 is weak in strength due to its construction as described above, so that it cannot withstand a great shock. Therefore, in order to withstand the shock, it is necessary to add parts, and to devise a shape thereof, and so forth. As a result, a significant increase in cost might eventually occur.

Even if the trailing edge regulating unit 13 has withstood the shock, when displacement occurs in respective regulating units, the loaded sheets S may be shifted or skewed from a predetermined position. There may occur such problems that a shift or inclination of the sheets causes a sheet jam, and a sheet and an image forming position are deviated from each other, thereby deteriorating an image quality, for example.

Figure 9:
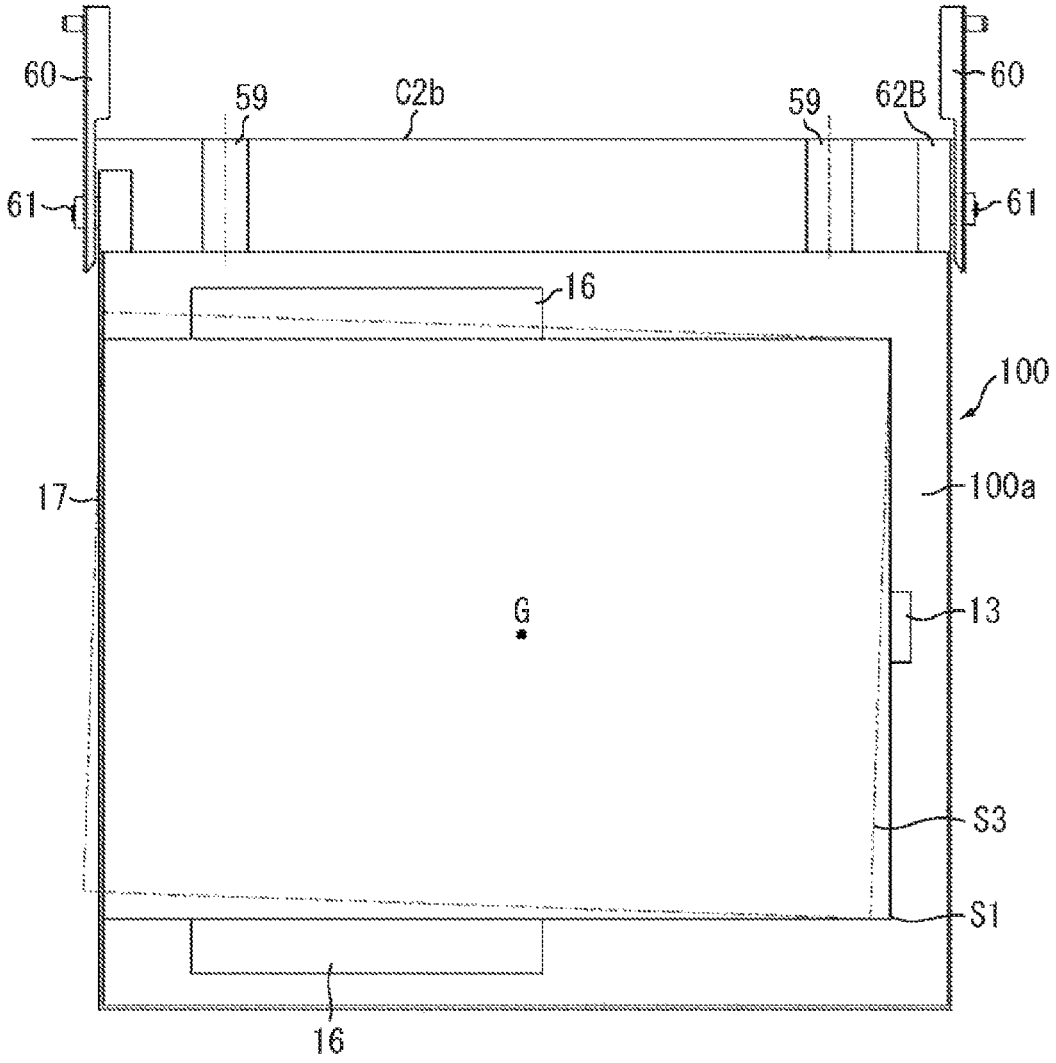
FIG. 9 is a plan view illustrating a housing operation of the sheet accommodating unit according to an exemplary embodiment of the present invention.

Thus, in the present exemplary embodiment, as illustrated in FIG. 9, an abutting portion 62B serving as an insertion position limiting unit is provided on the rear in an inserting direction of the sheet accommodating unit 100 and on upstream of a position of center of gravity G of the sheet accommodating unit 100 along the sheet feeding direction. The abutting portion 62B is set in its length so that it abuts against the back side frame C2*b*, when the sheet accommodating unit 100 is inserted into the frame C2*a* and brought into an over stroke.

While the position of center of gravity G of the sheet accommodating unit 100 is varied according to a size or a number of the loaded sheets, the abutting portion 62B is set in its position so that it abuts against the back side frame C2*b* on upstream of the position of center of gravity G along the sheet feeding direction.

By configuring the sheet accommodating unit 100 in such a manner, in FIG. 9, when the sheet on the operator's right rapidly stops, the sheet S1 tends to turn in the clockwise direction like S3 indicated by alternate long and two short dashes line in FIG. 9. However, the side edge regulating unit 16A on a rear and the leading edge regulating unit 17 that is fixedly arranged will regulate the turning of the sheet S1, thereby suppressing the turning of the sheet S1.

Since the leading edge regulating unit 17 needs not to be moved unlike other regulating units, it is fixed to the casing 100*a*. Further, in the configuration of the present exemplary embodiment, the leading edge regulating unit 17 constitutes a part of the casing 100*a* of the sheet accommodating unit 100.

The casing needs to have an appropriate rigidity, with the result that the strength of the leading edge regulating unit 17 also becomes high. Hence, as illustrated in FIG. 8, it becomes possible to surely prevent a shift of the sheets since the turning of the sheets is suppressed by the leading edge regulating unit 17 without relying on the trailing edge regulating unit 13 that is hardest to secure rigidity among the regulating units.

By using such a structurally strong portion for the leading edge regulating unit, the shift of the sheets can be surely prevented. Further, as a result, occurrence of sheet jam and deterioration of image quality can be prevented. Moreover, since increased strength of the regulating units, complicated locking mechanism, and a damper need not to be provided, reduction in costs can be possible.

Moreover, since a spring to absorb the shock is not necessary, a force for pushing the sheet accommodating unit until it is locked can be smaller, and thus users' operability can be improved.

Even if a shift of the sheets caused by a shock generated when the sheet accommodating unit 100 is pushed in could have been prevented by the leading edge regulating unit, the shock may damage the entire sheet accommodating unit, and the slide rail and the frame.

Figure 10:
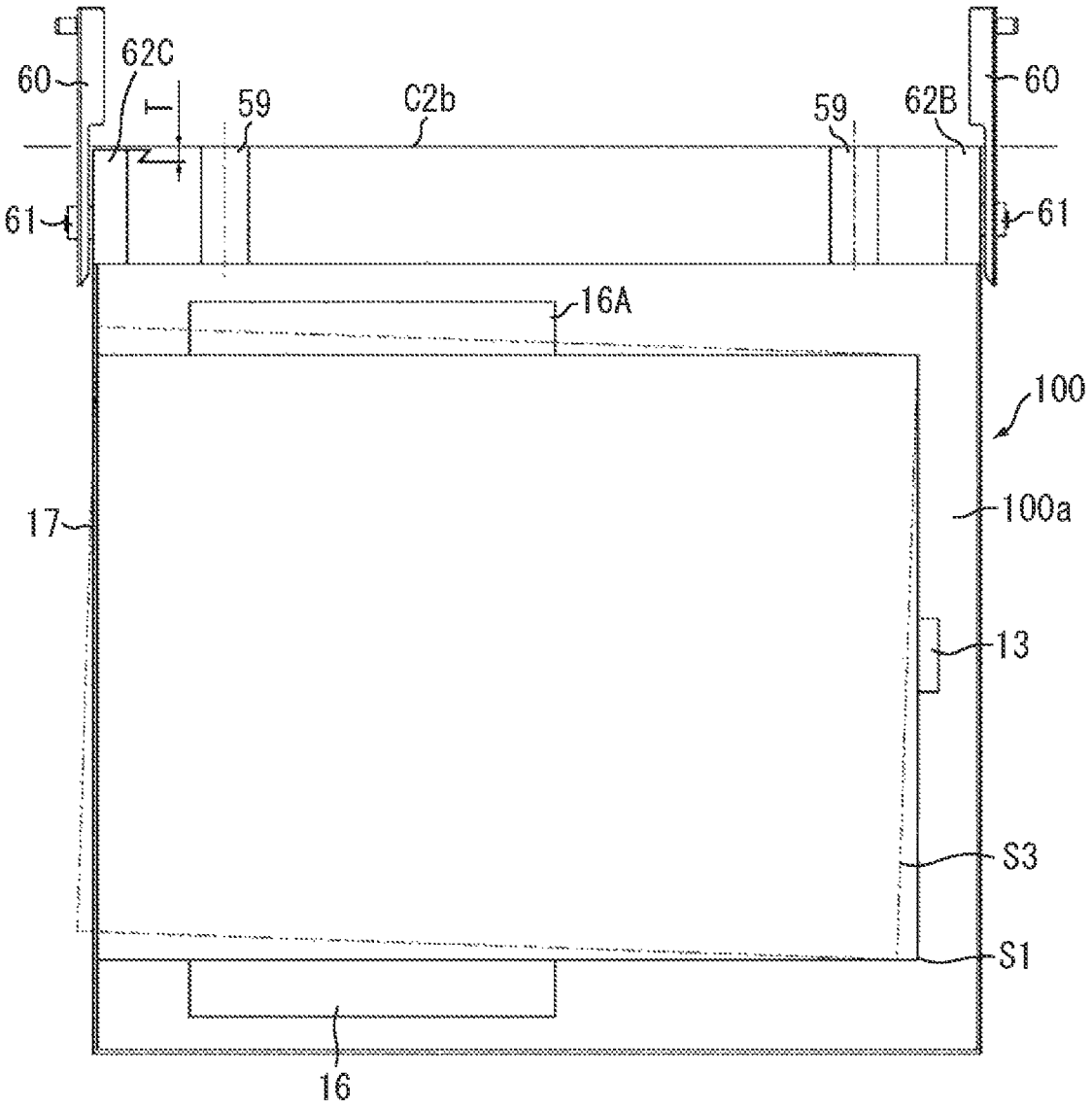
FIG. 10 is a plan view illustrating a housing operation of the sheet accommodating unit according to another exemplary embodiment of the present invention.

Thus, as a countermeasure, as illustrated in another exemplary embodiment in FIG. 10, an auxiliary abutting portion 62C serving as an auxiliary insertion position limiting unit may be also provided on the operator's left in FIG. 10 on the rear in the inserting direction of the sheet accommodating unit 100. The leading edge portion of the auxiliary abutting portion 62C is positioned toward front of the leading edge portion of the abutting portion 62B by a distance "T" in the inserting direction of the sheet accommodating unit 100.

According to the configuration, the sheet accommodating unit 100 rotates as a whole in the clockwise direction by a shock generated when the sheet accommodating unit 100 is pushed in to cause an over stroke, and accordingly the abutting portion 62B abuts against the back side frame C2*b*. However, even when the sheet accommodating unit 100 rotates, the abutting portion 62C contacts the back side frame C2*b* to limit the rotation of the sheet accommodating unit 100. As a result, damages of parts and an apparatus can be prevented.

A difference "T" between the leading edge positions in the abutting portions 62B and 62C located at right and left ends is set to a minimum value in consideration of dimensional variation of components, positional deviation occurring during assembly work.

In the present exemplary embodiment, the sheet feeding device C2 in which the feeding direction of the sheet in FIG. 2 is the arrow B direction in FIG. 2, and the leading edge regulating unit is arranged on the operator's left in FIG. 9, has been described. In the case where, like the sheet feeding device C1, the feeding direction of the sheet and the position of the leading edge regulating unit are reversed to those of the sheet feeding device C2, then relationship between the leading edge positions of the abutting portions is also left-right reversed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-010145 filed Jan. 20, 2009, which is hereby incorporated by reference herein in its entirety.

What is claimed is:

1. A sheet feeding device comprising:

a sheet accommodating unit that accommodates sheets, and supported by an apparatus main body in an insertable and withdrawable manner in a direction orthogonal to a feeding direction of the sheets;

a leading edge regulating unit provided fixedly to the sheet accommodating unit, configured to regulate a position on a downstream of the sheets to be accommodated in the feeding direction thereof;

a trailing edge regulating unit provided in the sheet accommodating unit, configured to regulate a position on an upstream of the sheets to be accommodated in the feeding direction;

a side edge regulating unit provided in the sheet accommodating unit, configured to regulate a position of the sheets to be accommodated in a direction orthogonal to the feeding direction thereof; and a locking mechanism to lock the sheet accommodating unit in a locking position in the apparatus main body including a spring which push out the sheet accommodating unit, a hook portion and protrusion portion which is engaged with the hook portion to lock the sheet accommodating unit in the apparatus main body against an elastic force of the spring; and a single insertion position limiting unit, the single insertion position limiting unit being provided only on a rear of the sheet accommodating unit in an inserting direction of the sheet accommodating unit and upstream from a center of gravity of the sheet accommodating unit in the sheet feeding direction, configured to be able to contact a frame on a rear of the apparatus main body in an inserting direction of the sheet accommodating unit to limit an insertion position of the sheet accommodating unit and a gap is formed between the single insertion position limiting unit and the frame on the rear of the apparatus main body when the locking mechanism locks the sheet accommodating unit in the locking position, wherein after the insertion position of the sheet accommodating unit is limited by the single insertion position limiting unit while insertion of the sheet accommodating unit, the sheet accommodating unit is moved to the locking position by the elastic force of the spring, wherein, in response to the sheet accommodating unit being inserted with an excessive force, the sheet accommodating unit rotates slightly about the single insertion position limiting unit, thus preventing damage to the side edge regulating unit and/or the trailing edge regulating unit.

2. The sheet feeding device according to claim 1, wherein the leading edge regulating unit is a part of a box-shaped casing of the sheet accommodating unit.

3. A sheet feeding device, comprising:

a sheet accommodating unit that accommodates sheets, and supported by an apparatus main body in an insertable and withdrawable manner in a direction orthogonal to a feeding direction of the sheets;

a leading edge regulating unit provided fixedly to the sheet accommodating unit, configured to regulate a position downstream of the sheets to be accommodated in the feeding direction thereof;

a trailing edge regulating unit provided in the sheet accommodating unit, configured to regulate a position upstream of the sheets to be accommodated in the feeding direction;

a side edge regulating unit provided in the sheet accommodating unit, configured to regulate a position of the sheets to be accommodated in a direction orthogonal to the feeding direction thereof;

a locking mechanism to lock the sheet accommodating unit in a locking position in the apparatus main body including a spring which push out the sheet accommodating unit, a hook portion and protrusion portion which is engaged with the hook portion to lock the sheet accommodating unit in the apparatus main body against an elastic force of the spring;

an insertion position limiting unit provided on a rear of the sheet accommodating unit in an inserting direction of the sheet accommodating unit and upstream from a center of gravity of the sheet accommodating unit in the sheet feeding direction, configured to be able to contact a frame on a rear of the apparatus main body in an inserting direction of the sheet accommodating unit to limit an insertion position of the sheet accommodating unit and a gap is formed between the insertion position limiting unit and the frame on the rear of the apparatus main body when the locking mechanism locks the sheet accommodating unit in the locking position; and an auxiliary insertion position limiting unit provided on the rear of the sheet accommodating unit in the inserting direction and downstream from the center of gravity of the sheet accommodating unit in the sheet feeding direction configured to be able to contact the frame on the rear of the apparatus main body in the inserting direction to limit the insertion position of the sheet accommodating unit and a leading edge portion of the auxiliary insertion position limiting unit in the inserting direction of the sheet accommodating unit is positioned upstream from a leading edge portion of the insertion position limiting unit in the inserting direction, wherein after the insertion position of the sheet accommodating unit is limited by the insertion position limiting unit while insertion of the sheet accommodating unit, the sheet accommodating unit is moved to the locking position by the elastic force of the spring, wherein, in response to the sheet accommodating unit being inserted with an excessive force, the sheet accommodating unit rotates slightly about the insertion position limiting unit, thus preventing damage to the side edge regulating unit and/or the trailing edge regulating unit.

4. An image forming apparatus including an image forming unit configured to form an image on a sheet fed from a sheet feeding device, the image forming apparatus comprising:

a sheet accommodating unit that accommodates sheets, and supported by an apparatus main body in an insertable and withdrawable manner in a direction orthogonal to a feeding direction of the sheets;

a leading edge regulating unit provided fixedly to the sheet accommodating unit, configured to regulate a position on a downstream in a feeding direction of the sheets to be accommodated;

a trailing edge regulating unit provided in the sheet accommodating unit, configured to regulate a position on an upstream in the feeding direction of the sheets to be accommodated;

a side edge regulating unit provided in the sheet accommodating unit, configured to regulate a position of the sheets to be accommodated in a direction orthogonal to the feeding direction thereof;

a locking mechanism to lock the sheet accommodating unit in a locking position in the apparatus main body including a spring which push out the sheet accommodating unit, a hook portion and protrusion portion which is engaged with the hook portion to lock the sheet accommodating unit in the apparatus main body against an elastic force of the spring; and a single insertion position limiting unit, the single insertion position limiting unit being provided only on a rear of the sheet accommodating unit in an inserting direction of the sheet accommodating unit, configured to be able to contact a frame on a rear of the apparatus main body in an inserting direction of the sheet accommodating unit to limit an insertion position of the sheet accommodating unit, wherein the single insertion position limiting unit is arranged on the rear of the sheet accommodating unit in the inserting direction thereof and upstream from a center of gravity of the sheet accommodating unit in the sheet feeding direction and a gap is formed between the single insertion position limiting unit and the frame on the rear of the apparatus main body when the locking mechanism locks the sheet accommodating unit in the locking position, wherein after the insertion position of the sheet accommodating unit is limited by the single insertion position limiting unit while insertion of the sheet accommodating unit, the sheet accommodating unit is moved to the locking position by the elastic force of the spring, wherein, in response to the sheet accommodating unit being inserted with an excessive force, the sheet accommodating unit rotates slightly about the single insertion position limiting unit, thus preventing damage to the side edge regulating unit and/or the trailing edge regulating unit.

5. The image forming apparatus according to claim 4, wherein the leading edge regulating unit is a part of a box-shaped casing of the sheet accommodating unit.

6. An image forming apparatus including an image forming unit configured to form an image on a sheet fed from a sheet feeding device, the image forming apparatus comprising:

a sheet accommodating unit that accommodates sheets, and supported by an apparatus main body in an insertable and withdrawable manner in a direction orthogonal to a feeding direction of the sheets;

a leading edge regulating unit provided fixedly to the sheet accommodating unit, configured to regulate a position downstream of the sheets to be accommodated in the feeding direction thereof;

a trailing edge regulating unit provided in the sheet accommodating unit, configured to regulate a position upstream of the sheets to be accommodated in the feeding direction;

a side edge regulating unit provided in the sheet accommodating unit, configured to regulate a position of the sheets to be accommodated in a direction orthogonal to the feeding direction thereof;

a locking mechanism to lock the sheet accommodating unit in a locking position in the apparatus main body including a spring which push out the sheet accommodating unit, a hook portion and protrusion portion which is engaged with the hook portion to lock the sheet accommodating unit in the apparatus main body against an elastic force of the spring;

an insertion position limiting unit provided on a rear of the sheet accommodating unit in an inserting direction of the sheet accommodating unit and upstream from a center of gravity of the sheet accommodating unit in the sheet feeding direction, configured to be able to contact a frame on a rear of the apparatus main body in an inserting direction of the sheet accommodating unit to limit an insertion position of the sheet accommodating unit; and an auxiliary insertion position limiting unit provided on the rear of the sheet accommodating unit in the inserting direction and downstream from the center of gravity of the sheet accommodating unit in the sheet feeding direction configured to be able to contact the frame on the rear of the apparatus main body in the inserting direction to limit the insertion position of the sheet accommodating unit and a leading edge portion of the auxiliary insertion position limiting unit in the inserting direction of the sheet accommodating unit is positioned upstream from a leading edge portion of the insertion position limiting unit in the inserting direction, wherein after the insertion position of the sheet accommodating unit is limited by the insertion position limiting unit while insertion of the sheet accommodating unit, the sheet accommodating unit is moved to the locking position by the elastic force of the spring, wherein, in response to the sheet accommodating unit being inserted with an excessive force, the sheet accommodating unit rotates slightly about the insertion position limiting unit, thus preventing damage to the side edge regulating unit and/or the trailing edge regulating unit.

* * * * *